US009855740B2

(12) United States Patent
Nakano

(10) Patent No.: US 9,855,740 B2
(45) Date of Patent: Jan. 2, 2018

(54) PRINTING APPARATUS AND CONTROL METHOD OF PRINTING APPARATUS

(71) Applicant: SEIKO EPSON CORPORATION, Tokyo (JP)

(72) Inventor: Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/247,732

(22) Filed: Aug. 25, 2016

(65) Prior Publication Data

US 2017/0057257 A1 Mar. 2, 2017

(30) Foreign Application Priority Data

Aug. 28, 2015 (JP) ..... 2015-168733

(51) Int. Cl.

| | |
|---|---|
| ***B41J 11/00*** | (2006.01) |
| ***B41J 2/01*** | (2006.01) |
| ***B41J 13/00*** | (2006.01) |
| ***B41J 15/00*** | (2006.01) |
| *B41J 2/17* | (2006.01) |

(52) U.S. Cl.

CPC ..... *B41J 2/01* (2013.01); *B41J 11/002* (2013.01); *B41J 13/0009* (2013.01); *B41J 15/005* (2013.01); *B41J 2/1714* (2013.01); *B41J 11/0015* (2013.01)

(58) Field of Classification Search

CPC ..... B41J 2/01; B41J 11/002; B41J 13/0009; B41J 2/1714; B41J 11/0015; B41J 15/005

See application file for complete search history.

(56) References Cited

U.S. PATENT DOCUMENTS

| | | | | |
|---|---|---|---|---|
| 6,267,518 | B1 | 7/2001 | Abe | |
| 2003/0122915 | A1 | 7/2003 | Katoh et al. | |
| 2003/0161552 | A1* | 8/2003 | Shima | B41J 11/002 382/312 |
| 2010/0050347 | A1 | 3/2010 | Fukui | |
| 2015/0029280 | A1* | 1/2015 | Sasaki | B41J 11/002 347/102 |

FOREIGN PATENT DOCUMENTS

| | | |
|---|---|---|
| JP | 10-166566 | 6/1998 |
| JP | 2003-220701 | 8/2003 |
| JP | 2004-106346 | 4/2004 |
| JP | 2008-044130 | 2/2008 |
| JP | 2010-053497 | 3/2010 |

* cited by examiner

*Primary Examiner* — Manish S Shah
*Assistant Examiner* — Yaovi M Ameh
(74) *Attorney, Agent, or Firm* — Workman Nydegger

(57) ABSTRACT

A printing apparatus including a printing head that discharges a liquid onto a paper sheet, a drying section into which it is possible to the paper sheet, a transport roller that is provided further on an upstream side than the drying section, a nip roller that is provided further on a downstream side than the drying section, and a control section that regulates movement of the paper sheet by controlling the nip roller, in which the control section performs a first transport control that transports paper sheet in the transport direction by driving the transport roller, and stops driving of the nip roller, and a second transport control that stops driving of the transport roller, and transports the paper sheet in the transport direction by driving the nip roller.

6 Claims, 11 Drawing Sheets

PRINTING APPARATUS AND CONTROL METHOD OF PRINTING APPARATUS

BACKGROUND

1. Technical Field

The present invention relates to a printing apparatus and a control method of a printing apparatus.

2. Related Art

In large format printers, and the like, roll-to-roll method printing apparatuses that supply a recording medium as rolled paper that is wound up in a cylindrical form, and accommodate a recording medium on which images, or the like, are formed, wound up in roll shape, are used. Such a printing apparatus is provided with a drying furnace and a drying device, which dry printing surfaces, in an ejection pathway from a recording section that performs printing on a recording medium up to an accommodation section that accommodates a recording medium in roll shape. For example, JP-A-2004-106346 discloses a paper sheet drying device that performs drying of printing and image formation portions by disposing a paper sheet rear surface holding member in an ejection pathway of an image formation medium (recording medium), causing the paper sheet rear surface holding member to abut against a rear surface of an image formation medium on which printing and image formation is complete, and directing air from an air blower toward a printing and image formation portion of the image formation medium while holding the rear surface of the image formation medium, and a recording apparatus (printing apparatus) that is provided with the paper sheet drying device.

In a printing apparatus that is provided with such a drying furnace (drying section), in a case in which a heat-sensitive material is used in a recording medium, it is necessary to dry the recording medium at a low drying temperature over a long period of time by increasing the length of a transport pathway inside the drying section of the printing apparatus. In the same manner, in a case in which the printing apparatus is sped up, it is necessary to increase the length of the transport pathway inside the drying section of the printing apparatus. In addition, in a case of a roll-to-roll method printing apparatus, it is necessary to set a recording medium along a transport pathway from a roll (a feeding section) on a supply side up to a roll (a take-up section) on an accommodation side before the start of printing. However, when the length of a transport pathway inside a drying section of a printing apparatus is increased, the length of a transport pathway from a printing head, which discharges a liquid onto a recording medium up to a take-up section is increased, a region in which printing, such as image formation on a recording medium, is not possible increases at the start and at the end of printing, and therefore, there is a problem in that a production efficiency of the printing apparatus is reduced. Accordingly, it is difficult to configure a printing apparatus in which the production efficiency is high, and the transport pathway inside a drying section is long.

SUMMARY

The invention can be realized in the following aspects or application examples.

Application Example 1

According to this application example, there is provided a printing apparatus including a printing head that discharges a liquid onto a recording medium, a drying section into which it is possible to insert the recording medium, a transport roller that transports the recording medium in a transport direction, and is provided further on an upstream side than the drying section in the transport direction, a nip roller that is provided further on a downstream side than the drying section in the transport direction, and a control section that regulates movement of the recording medium by controlling the nip roller, in which the control section performs a first transport control that transports the recording medium in the transport direction by driving the transport roller, and stops driving of the nip roller, and a second transport control that stops driving of the transport roller, and transports the recording medium in the transport direction by driving the nip roller.

According to the application example, the printing apparatus is provided with a nip roller that regulates movement of the recording medium on a downstream side of the drying section. In the printing apparatus according to the application example, when the recording medium is set in the printing apparatus before the start of printing, the recording medium is suspended above the drying section. When printing is initiated, the control section performs the first transport control, which transports the recording medium in the transport direction by driving the transport roller, which is provided on the upstream side of the drying section, and regulates the movement of the recording medium by stopping driving of the nip roller, which is provided on the downstream side, and clamping the recording medium. As a result of this, a recording medium that is provided across the drying section in a suspended manner is inserted inside the drying section sagging down in a U-shape. Thereafter, as a result of the control section performing control that transports the recording medium by driving the nip roller by the same transport amount as the transport roller, a long transport pathway is formed in a U-shape inside the drying section.

In addition, at the end of printing, as a result of the control section performing the second transport control, which stops the transport of the recording medium by stopping driving of the transport roller, and continues transport of the recording medium by driving the nip roller, a recording medium, which is sagging down in a U-shape inside the drying section, is wound up, and the recording medium is suspended above the drying section.

As a result of this, since a long transport pathway is formed inside the drying section during printing, and the transport pathway is short before the start and at the end of printing, it is possible to reduce a region in which it is not possible to perform printing on a recording medium before and after the start of printing. Accordingly, it is possible to provide a printing apparatus in which the production efficiency is high, and the transport pathway inside a drying section is long.

Application Example 2

It is preferable that the printing apparatus according to the application example further include an assist roller that leads the recording medium inside the drying section.

According to the application example, the printing apparatus is provided with an assist roller that leads the recording medium. As a result of the recording medium sagging down between the nip roller and the assist roller, it is possible to insert the recording medium inside the drying section in a state in which the recording medium is stabilized in a U-shape. In addition, it is possible to form a transport pathway that is stabilized in a U-shape inside the drying section.

Application Example 3

In the printing apparatus according to the application example, it is preferable that the drying section includes a heat source that emits heat, and an air blowing fan that blows external air inside the drying section.

According to the application example, since the printing apparatus is provided with a heat source and an air blowing fan which feed hot air into the drying section, it is possible to dry a recording medium, which is inserted into the drying section in a U-shape, with high efficiency by keeping the inside of the drying section at a predetermined temperature.

Application Example 4

In the printing apparatus according to the application example, it is preferable that the drying section includes a medium detection sensor that detects the recording medium.

According to the application example, since the printing apparatus is provided with a medium detection sensor that detects a recording medium in the drying section, it is possible to detect an insertion amount to which a recording medium is inserted inside the drying section in a U-shape. Furthermore, by controlling a rotation amount of the nip roller on the basis of a signal that is output from the medium detection sensor, it is possible to keep the insertion amount of a recording medium to a predetermined value.

Application Example 5

In the printing apparatus according to the application example, it is preferable that the drying section includes a condensation induction plate that is provided in a position that faces an exhaust port, and causes matter, which is included in vapor that is ventilated from the exhaust port, to form as condensation.

According to the application example, since the printing apparatus is provided with a condensation induction plate in a position that faces an exhaust port of the drying section, it is possible to cause vaporized matter to form as condensation on the condensation induction plate by causing vapor, which includes matter in which a liquid discharged onto a recording medium is vaporized inside the drying section, to come into contact with the condensation induction plate. As a result of this, since vapor that is ejected from the drying section is purified, it is possible to reduce staining of the printing apparatus and a recording medium that occurs due to vaporized matter becoming attached thereto.

Application Example 6

According to this application example, there is provided a control method of a printing apparatus that includes a printing head that discharges a liquid onto a recording medium, a drying section into which it is possible to insert the recording medium, a transport roller that transports the recording medium in a transport direction and is provided further on an upstream side than the drying section in the transport direction, a nip roller that is provided further on a downstream side than the drying section in the transport direction, and a control section that regulates movement of the recording medium by controlling the nip roller, the control method including performing a first transport control that transports the recording medium in the transport direction by driving the transport roller, and stops driving of the nip roller, and performing a second transport control that stops driving of the transport roller, and transports the recording medium in the transport direction by driving the nip roller.

According to the application example, the control method of a printing apparatus includes the first transport control that transports the recording medium in the transport direction by driving the transport roller, and stops driving of the nip roller, and the second transport control that stops driving of the transport roller, and transports the recording medium in the transport direction by driving the nip roller. In the setting of a recording medium in the printing apparatus before the start of printing, a recording medium that is suspended above the drying section is inserted inside the drying section sagging down in a U-shape due to the first transport control of the control section. Thereafter, as a result of the control section performing control that transports the recording medium by driving the nip roller by the same transport amount as the transport roller, a long transport pathway is formed in a U-shape inside the drying section.

In addition, at the end of printing, a recording medium, which is sagging down in a U-shape inside the drying section, is wound up and suspended above the drying section due to the second transport control of the control section.

As a result of the control method of a printing apparatus according to the application example, since it is possible to configure a printing apparatus in which a long transport pathway is formed inside the drying section during printing, and the transport pathway is short before the start and at the end of printing, it is possible to reduce a region in which it is not possible to perform printing on a recording medium before and after the start of printing. Accordingly, it is possible to provide a control method of a printing apparatus according to which it is possible to configure a printing apparatus in which the production efficiency is high, and the transport pathway inside a drying section is long.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. In addition, in each of the drawings below, the scales of each member is altered from a practical scale in order to make each layer have a size that is easy to understand.

In addition, in FIGS. 1 to 5 and FIGS. 8 to 11, for the sake of convenience, an X axis, a Y axis and a Z axis are illustrated as three axes that are orthogonal to one another, a tip end side of an arrow that illustrates an axial direction is referred to as a "+ side", and a base end side thereof is referred to as a "− side". A direction that is parallel to the X axis is referred to as an "X axis direction", a direction that is parallel to the Y axis is referred to as a "Y axis direction" and a direction that is parallel to the Z axis is referred to as a "Z axis direction".

Embodiment 1

Figure 1:
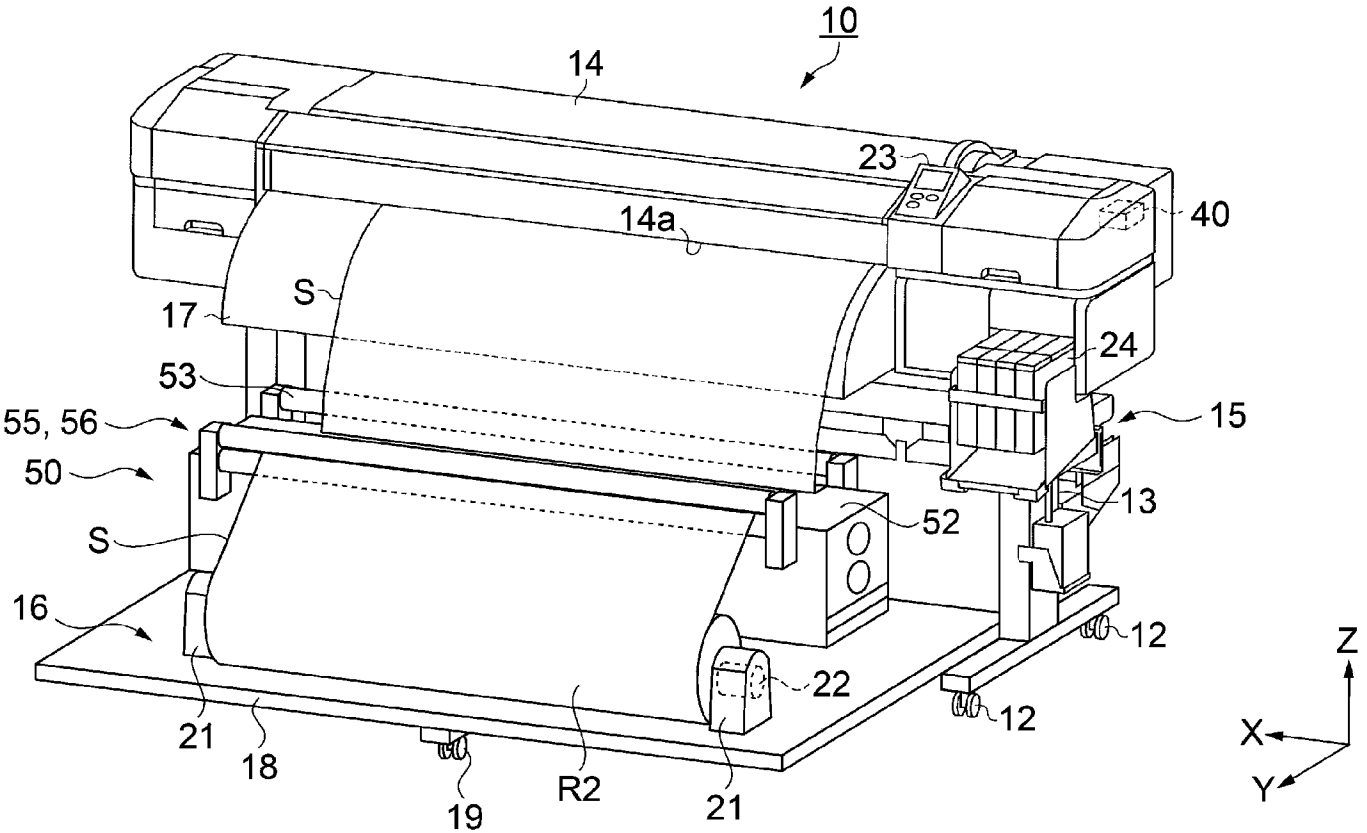
FIG. 1 is a schematic diagram that shows an outline configuration of a printing apparatus according to Embodiment 1.
Figure 2:
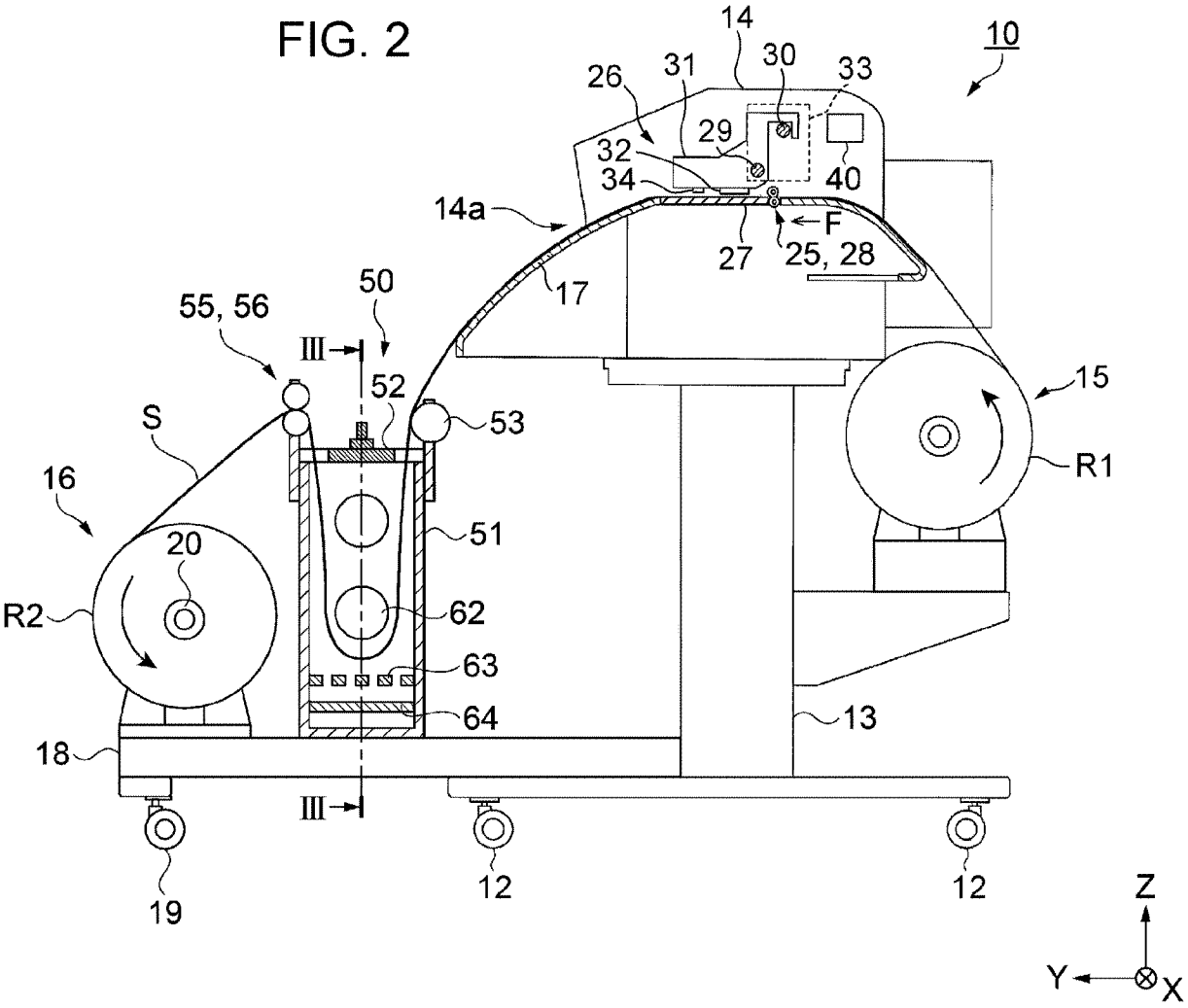
FIG. 2 is a lateral cross-sectional view of the printing apparatus.

FIG. 1 is a schematic diagram that shows an outline configuration of a printing apparatus according to Embodiment 1. FIG. 2 is a lateral cross-sectional view of the printing apparatus. Firstly, an outline configuration of a printing apparatus 10 according to the present embodiment will be described with reference to FIGS. 1 and 2.

Outline Configuration of Printing Apparatus

As shown in FIGS. 1 and 2, the printing apparatus 10 is a roll-to-roll method large format printer (LFP), which includes a feeding section 15 that supplies a long paper sheet S, which is an example of recording medium, as a rolled body R1 that is wound up in cylindrical form, and a take-up section 16 that recovers the long paper sheet S after printing as a rolled body R2, by taking up the paper sheet S. For example, it is possible to use various types of paper, fabric, film, or the like, as a recording medium.

The printing apparatus 10 is provided with a pair of leg sections 13, the lower ends of which wheels 12 that move the printing apparatus 10, are attached to, a recording section housing 14, which is assembled on the leg sections 13, the feeding section 15, which is supported by the leg sections 13, and a drying section 50 and the take-up section 16, which are provided on a pedestal 18 that is supported by the pair of leg sections 13 and a wheel 19, and the like. Additionally, in the present embodiment, an up-down direction along a vertical direction is set as the Z axis, and the +Z axis is set as "up". A longitudinal direction (a width direction) of the recording section housing 14, which intersects (is orthogonal to, in the present embodiment) the Z axis is set as the X axis, and the +X axis side is set as "left". In addition, a direction (a front-back direction) that intersects (is orthogonal to, in the present embodiment) both the Z axis and the X axis is set as the Y axis, and the +Y axis side is set as "front".

A control section 40, which controls the actions of the printing apparatus 10 is provided inside the recording section housing 14. In addition, an operation panel 23 for performing a setting operation and an input operation, is provided on a right end side of an upper portion of the recording section housing 14. Additionally, the operation panel 23 is electrically connected to the control section 40.

A liquid accommodation container 24, which is capable of accommodating ink, is provided in a lower portion of the recording section housing 14 on the right end side (the −X axis side), which is on an outer side of the transport pathway of the paper sheet S in the width direction (the X axis direction). A plurality of liquid accommodation containers 24 are provided to correspond to types and colors of ink. In the present embodiment, four liquid accommodation containers 24, which accommodate four colors (for example, cyan: C, magenta: M, yellow: Y and black: K) of ink, are provided.

The feeding section 15, which is supported by the leg sections 13, and feeds the paper sheet S toward a recording section housing 14 side, is disposed below a rear side of recording section housing 14. A medium guide section 17 is disposed in the recording section housing 14 along the transport pathway of the paper sheet S.

The rolled body R1, in which unused paper sheet S is wound up in cylindrical form, is retained in the feeding section 15. Additionally, a plurality of sizes of the rolled body R1 having paper sheets S with different widths (lengths in the X axis direction) and winding numbers are loaded into the feeding section 15 in an exchangeable manner. In addition, regardless of size, the rolled body R1 is loaded into the feeding section 15 in a state of being flush with the right end side (the −X axis side) in the X axis direction. Further, as a result of the feeding section 15 rotating the rolled body R1 in an anticlockwise direction in FIG. 2, the paper sheet S is unwound from the rolled body R1 and is fed inside the recording section housing 14 along the medium guide section 17.

A rear end side of the medium guide section 17 is accommodated inside the recording section housing 14, and a front end side thereof protrudes toward the front from the recording section housing 14. In addition, an ejection port 14*a* for ejecting the paper sheet S from inside the recording section housing 14, is formed on a front surface side of the recording section housing 14 in a position that corresponds to an upper side of the medium guide section 17.

A transport roller 25 that transports the paper sheet S in the transport direction, which is shown by an arrow F in FIG. 2, is provided inside the recording section housing 14. The transport roller 25 is positioned further on an upstream side in the transport direction of the paper sheet S than the drying section 50, and has a longer axial length than the width of paper sheet S that can be used by the printing apparatus 10. The transport roller 25 is configured by a pair of rollers that clamp the paper sheet S from the up-down direction (the ±Z axis direction), and includes a transport motor 28 that supplies a rotational force to one of the rollers. When one of the rollers is driven in a rotational manner as a result of driving of the transport motor 28, the other roller follows the rotation, and the paper sheet S, which is clamped between the two rollers, is transported to a downstream side (the +Y axis direction) in the transport direction.

In addition, a recording section 26, which is provided further on the downstream side than the transport roller 25, and performs printing (recording) on the paper sheet S that is transported, is accommodated inside the recording section housing 14. Furthermore, a medium support section 27 that forms a portion of the medium guide section 17, and supports the paper sheet S, is provided in a position that faces the recording section 26 through the paper sheet S.

The recording section 26 is provided with a guide shafts 29 and 30 that are provided in a hanging manner so as to extend in the width direction (the X axis direction), a carriage 31 that is supported by the guide shafts 29 and 30, and a printing head 32 that is retained in a lower section of the carriage 31 and discharges a liquid onto the paper sheet S, as a recording medium. Further, the carriage 31 reciprocates along the guide shafts 29 and 30 within a movement region that extends in a main scanning direction (the X axis direction), which is orthogonal to the transport direction of the paper sheet S.

Adjustment mechanisms 33, which change the height (the position in the Z axis direction) of the printing head 32 in order to adjust a separation distance between the printing head 32 and the paper sheet S, are provided in both end portions in the width direction (the X axis direction) of the guide shafts 29 and 30. In addition, a reflective sensor 34, as a paper width sensor, is retained in a lower portion of the carriage 31 in a position that is further on the downstream side in the transport direction than the printing head 32.

The reflective sensor 34 is an optical type sensor that is provided with a light source section and a light reception section, which are not illustrated in the drawings, receives, with the light reception section, reflected light of light that is emitted toward a lower portion from the light source section, and outputs a detection value V (a voltage value), which depends on an intensity of reflected light received with the light reception section, to the control section 40. In addition, the width (the length in the X axis direction) of the paper sheet S is calculated by performing detection using the reflective sensor 34 while moving the carriage 31 in the main scanning direction, and the control section 40 sensing positions of a reflection target that change on the basis of the detection value V, that is, the positions of both end portions of the paper sheet S in the width direction (the X axis direction).

Further, recording (printing) of an image, or the like, on the paper sheet S is performed by discharging ink, which is supported from the liquid accommodation containers 24, onto the paper sheet S, which is transported along the transport pathway, while the printing head 32 moves in the main scanning direction with the carriage 31 depending on the detected width of the paper sheet S. Additionally, in the present embodiment, a serial head type printing head, which is installed in the movable carriage 31 and discharges ink while moving in the width direction (the X axis direction) of the paper sheet S, is illustrated as the printing head 32 by way of example, but a line head type printing head in which the printing head 32 is provided throughout the entirety of the width direction (the X axis direction) of the paper sheet S, may also be used.

Figure 3:
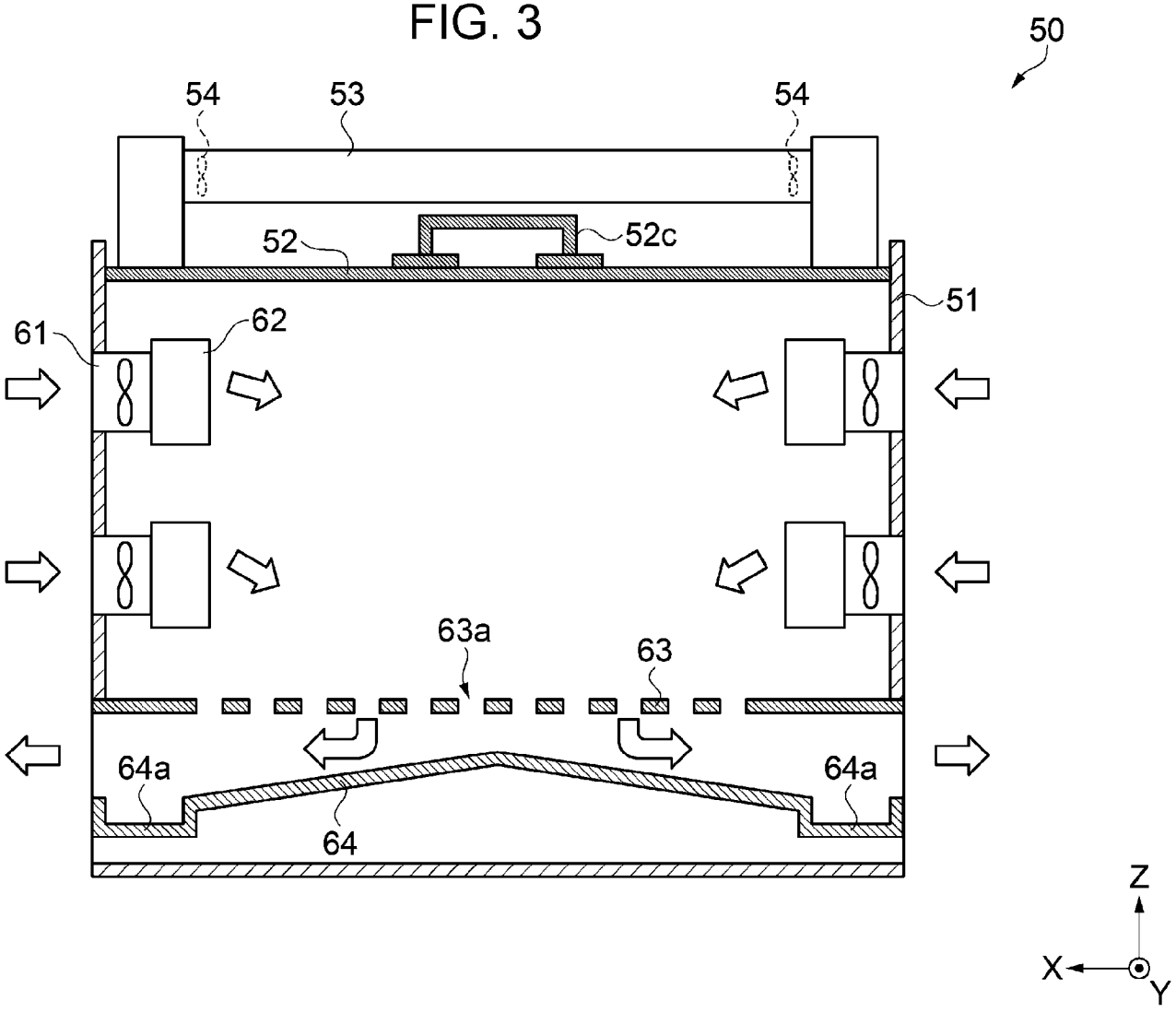
FIG. 3 is a cross-sectional view of a drying section along a line III-III in FIG. 2.
Figure 4:
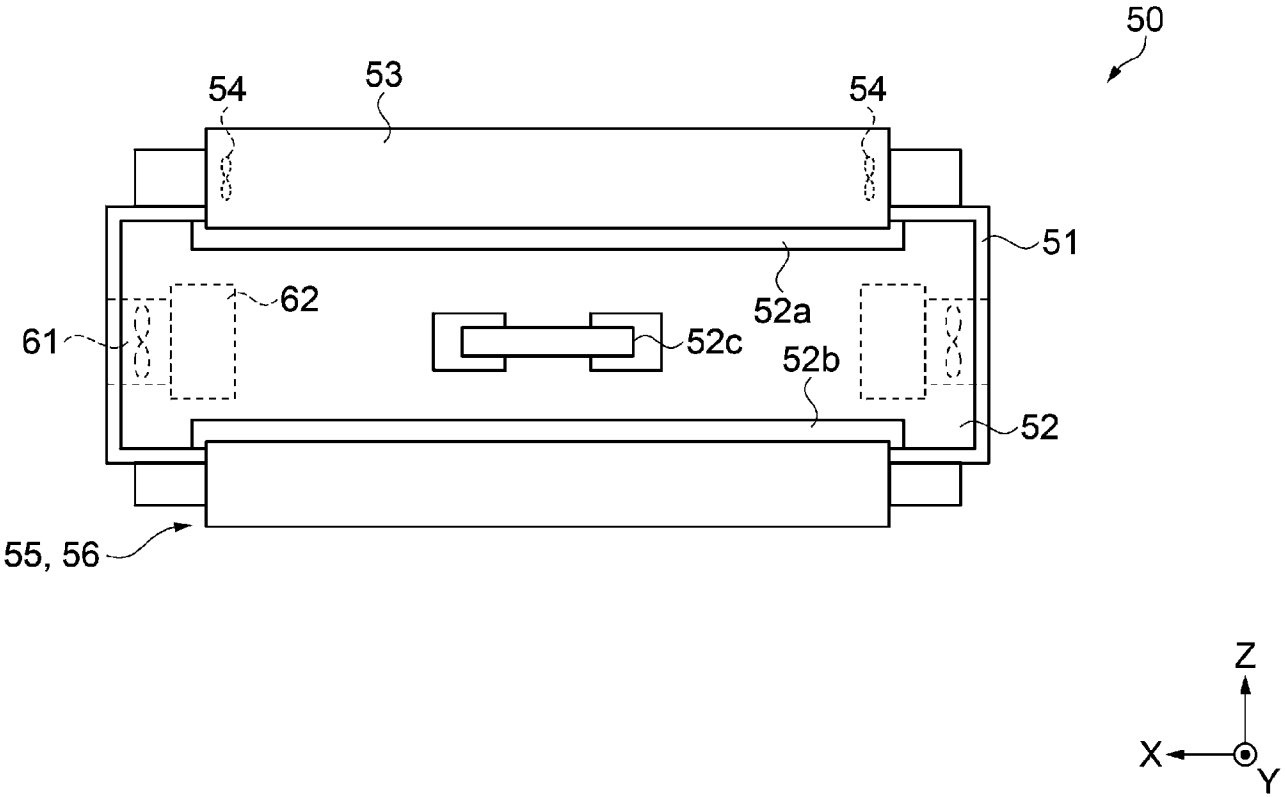
FIG. 4 is a plan view of the drying section.

FIG. 3 is a cross-sectional view of a drying section along a line III-III in FIG. 2. FIG. 4 is a plan view of the drying section. Additionally, in FIGS. 3 and 4, illustration of the paper sheet S is omitted. In addition, in FIG. 3, directions of air streams are illustrated using "arrows". The drying section 50 will be described with reference to FIGS. 1 to 4.

The drying section 50 includes a rectangular parallelepiped drying section housing 51 in which the upper surface (a surface of the +Z axis side) is open, a lid 52 that covers the upper surface of the drying section housing 51, a drying furnace that includes an exhaust plate 63, which includes exhaust ports 63*a*, and is surrounded by the lid 52, the exhaust plate 63 and the drying section housing 51, and an ejection pathway that is surrounded by the exhaust plate 63 and a lower portion of the drying section housing 51. In addition, the drying section housing 51 is provided with an assist roller 53 that leads the paper sheet S, as a recording medium, inside the drying furnace of the drying section 50, and a nip roller 55 that clamps the paper sheet S. The drying section 50 has a configuration in which it is possible to insert the paper sheet S, as a recording medium, into the drying furnace from above (the +Z axis side) in a state in which the lid 52 is removed.

The assist roller 53 is supported by the drying section housing 51, and is provided above (in the +Z axis direction) the drying section 50 (the drying section housing 51) on an upstream side (the −Y axis side) in the transport direction of the paper sheet S. The assist roller 53 has a longer axial length than the width of paper sheet S that can be used by the printing apparatus 10. The assist roller 53 includes a plurality of pores that are in communication with a surface and a shaft hole of the assist roller 53, and fans 54, which generate air streams from inside to outside the shaft hole, are provided at both ends of the assist roller 53. The paper sheet S that is transported by the transport roller 25 is suctioned to the surface of the assist roller 53 as a result of driving of the fans 54. The assist roller 53 leads the suctioned paper sheet S inside the drying furnace of the drying section 50 by rotating in accordance with movement of the paper sheet S.

The nip roller 55 is supported by the drying section housing 51, and is provided above (in the +Z axis direction) the drying section 50 (the drying section housing 51) on a downstream side (the +Y axis side) in the transport direction of the paper sheet S. The nip roller 55 has a longer axial length than the width of paper sheet S that can be used by the printing apparatus 10. The nip roller 55 is configured by a pair of rollers that clamp the paper sheet S from the up-down direction (the ±Z axis direction), and includes a nipping motor 56 that supplies a rotational force to one of the rollers. When one of the rollers is driven in a rotational manner as a result of driving of the nipping motor 56, the other roller follows the rotation, and the paper sheet S, which is clamped between the two rollers, is transported to the take-up section 16. Paper sheet S on which printing is performed by the recording section 26 and which is ejected from the ejection port 14*a*, is inserted inside the drying furnace of the drying section 50 in a state of sagging down in a U-shape between the assist roller 53 and the nip roller 55.

The lid 52 is a component that covers the top of the drying furnace of the drying section 50 in an attachable and removable manner. The lid 52 is provided with a handle 52*c* for carrying the lid 52 during attachment or removal, and an introduction port 52*a*, through which the paper sheet S is introduced inside the drying furnace in a state in which the lid 52 is mounted, and a lead-out port 52*b*, through which the paper sheet S is led out from inside the drying furnace, are provided.

The drying furnace of the drying section 50 is provided with heat sources 62 that emit heat, and fans 61 that blow external air inside the drying furnace, on the side walls in the width direction (the ±X axis direction) of the drying section housing 51. The heat sources 62 and the fans 61 are combined in the order of a fan 61 and a heat source 62 along the X axis direction from outside to inside the drying furnace, and two sets of heat source 62 and fan 61 are provided on the respective side walls along the Z axis direction. The fans 61 dry a printing surface of the paper sheet S, which is inserted inside the drying furnace by feeding hot air obtained by supplying external air to the heat source 62, into the inside of the drying furnace. The heat sources 62 can be configured by a heating wire using an alloy in which nickel and chromium are the main components (nichrome), an alloy of iron, chromium and aluminum (Kanthal: (registered trademark)), or the like. Additionally, the number and positions of the heat sources 62 and the fans 61 that are provided in the present embodiment, are merely an example, and are not limited to the above configuration. The heat sources 62 and the fans 61 are disposed optimally depending on the shape and size of the drying furnace, the heat capacity of the heat source 62, the air flow of the fan 61, and the like.

An exhaust plate 63, which includes a plurality of the exhaust ports 63*a*, which ventilate air streams in a bottom surface direction after drying ink that is discharged onto the paper sheet S, is provided below the drying section housing 51, and furthermore, a condensation induction plate 64 is provided below the exhaust plate 63 in a position that faces the exhaust plate 63, which includes the exhaust ports 63*a*. The condensation induction plate 64 has an inclined portion that gradually descends in both directions (the ±X axis direction) from the center in the X axis direction, and the ejection pathway is formed by the exhaust plate 63 and the condensation induction plate 64. Matter, such as solvent that is vaporized when ink is dried, is included in vapor that is ejected from the exhaust ports 63*a*, and the condensation induction plate 64 is a component that causes matter, which is included in vapor ventilated from the exhaust ports 63*a* to form as condensation. Gutter-shaped capture sections 64*a* are provided at in end portions of the condensation induction plate 64 in the ±X axis direction. Vapor that is ventilated from the exhaust ports 63*a* collides with the inclined portion of the condensation induction plate 64, passes the ejection pathway along the incline of the inclined portions, and is ejected from below both side surfaces in the X axis direction of the drying section housing 51.

The matter that is included in the vapor forms as condensation on the condensation induction plate 64 as a result of coming into contact with the condensation induction plate 64, and liquefied matter is lead along the incline of the condensation induction plate 64 and stored in the capture sections 64*a*. As a result of this, since vapor that is ejected from the drying section 50 is purified, it is possible to reduce staining of the printing apparatus 10 and the paper sheet S that occurs due to vaporized matter becoming attached thereto. In addition, since vaporized matter is retained in the capture sections 64*a*, it is possible to easily recover the vaporized matter. Additionally, the shape of the condensation induction plate 64 is an example, and may be a configuration that is inclined in a single direction. In addition, the condensation induction plate 64 may be provided with a fan and a cooling device that cool the condensation induction plate 64. As a result of this, it is possible to promote condensation of vaporized matter. In addition, the capture sections 64*a* may be provided with an adsorbing material such as a fiber or a sponge. As a result of this, it is possible to easily recover vaporized matter.

As shown in FIGS. 1 and 2, the take-up section 16 is provided with a pair of holders 21 between which a core material 20 for forming the rolled body R2 by taking up the paper sheet S. One holder 21 includes a take-up motor 22 that supplies a rotational force to the core material 20. As a result of the core material 20 rotating due to the take-up motor 22 being driven, the paper sheet S is taken up onto the core material 20 and the rolled body R2 is formed. It is possible to correct thermal deformations of the paper sheet S that are generated inside the drying furnace of the drying section 50 by taking up the paper sheet S while applying tension thereto between the nip roller 55 and the rolled body R2 using the take-up motor 22.

Figure 5:
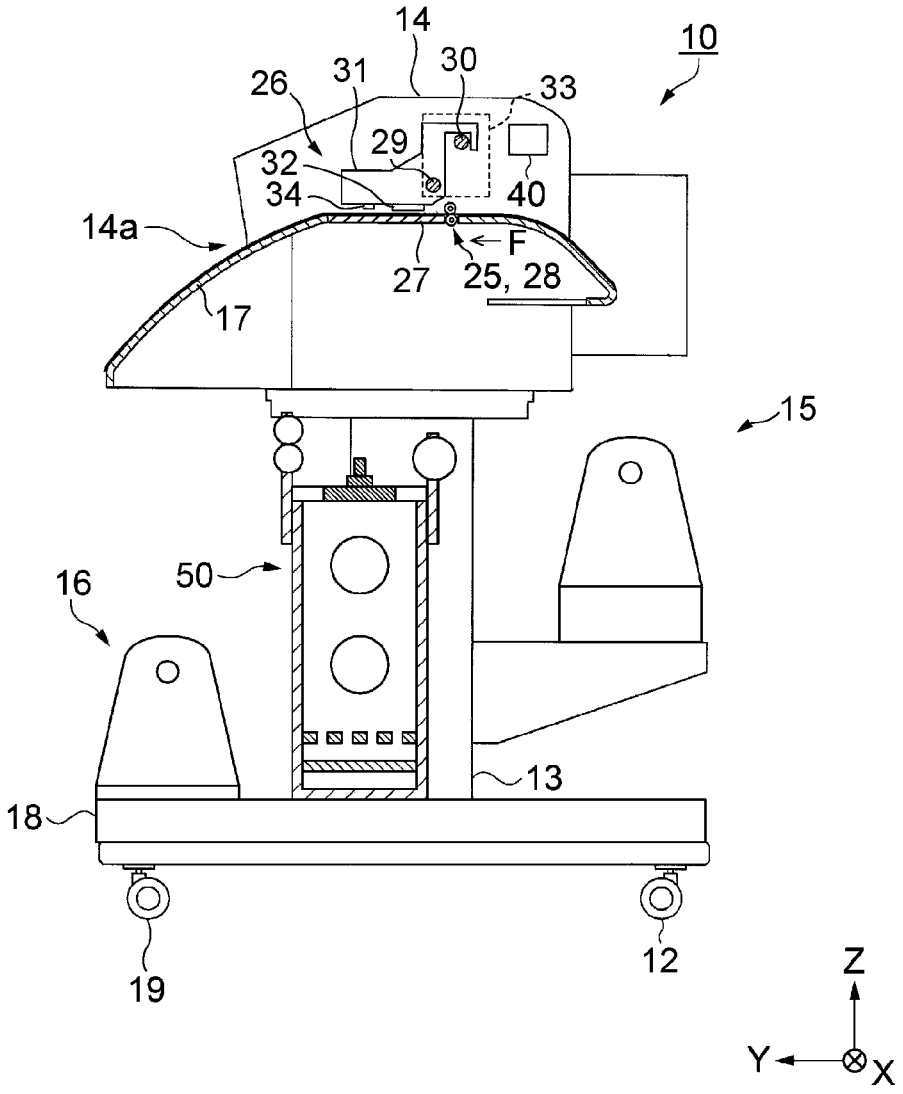
FIG. 5 is a lateral cross-sectional view that shows a general configuration of the printing apparatus during machine body installation.

FIG. 5 is a lateral cross-sectional view that shows a general configuration of the printing apparatus during machine body installation. As shown in FIG. 5, the drying section 50 and the take-up section 16 is supported by the pair of leg sections 13 and the wheel 19 of the printing apparatus 10, and are provided on the pedestal 18 in a manner that is movable in the front-back direction (the Y axis direction) of the printing apparatus 10. By moving the pedestal 18 in a back direction (the −Y axis direction), the drying section 50 and the take-up section 16 are housed in a space that is formed between the bottom of the recording section housing 14 and the pair of leg sections 13. As a result of this, it is possible to reduce the work during machine body installation of the printing apparatus 10.

Electrical Configuration of the Printing Apparatus

Figure 6:
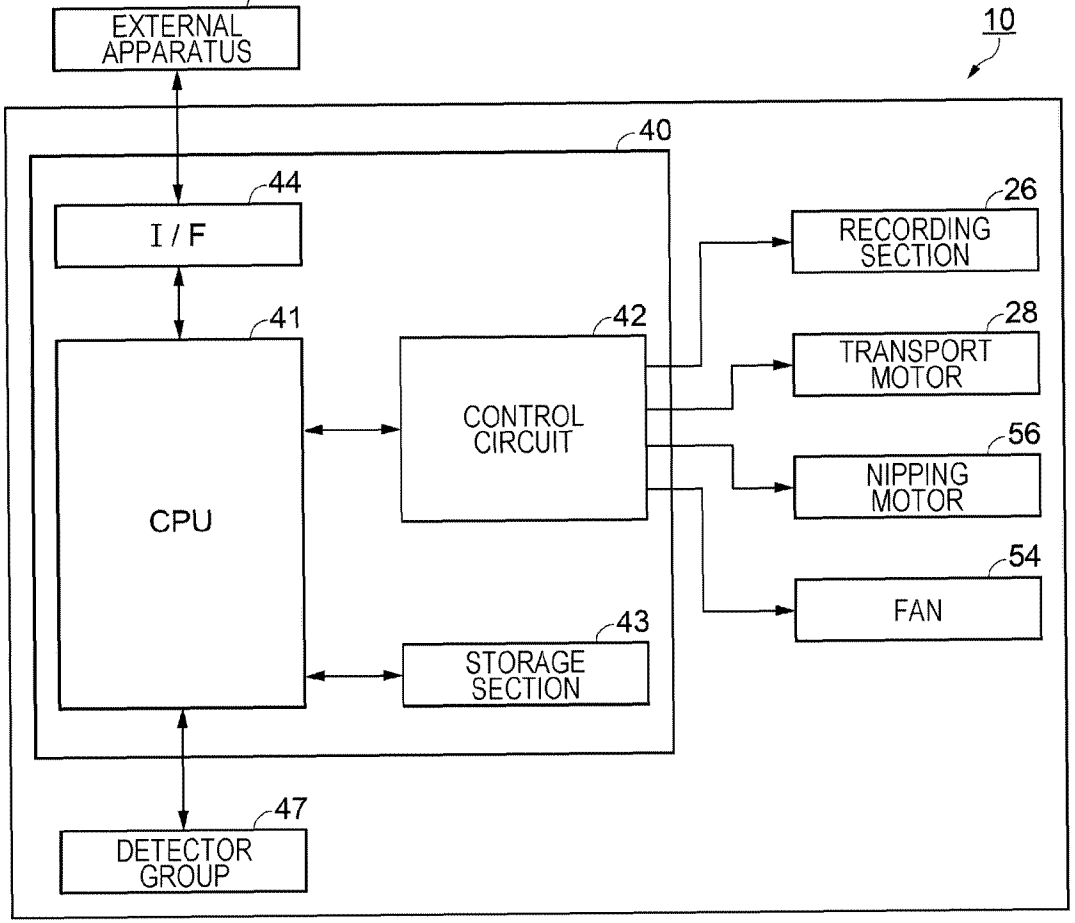
FIG. 6 is a block diagram that shows an electrical configuration of the printing apparatus.

FIG. 6 is a block diagram that shows an electrical configuration of the printing apparatus. Next, the electrical configuration of the printing apparatus 10 will be described with reference to FIG. 6.

The printing apparatus 10 is provided with the control section 40. The control section 40 is a control unit for performing control of the printing apparatus 10. The control section 40 is configured to include a control circuit 42, an interface section (I/F) 44, a Central Processing Unit (CPU) 41, and a storage section 43. The interface section 44 is a section for performing the communication of data between an external apparatus 46, such as a computer or a digital camera, which handles images and the printing apparatus 10. The CPU 41 is an arithmetic processing device for performing an input signal process from various detector groups 47 and overall control of the printing apparatus 10.

The storage section 43 is a component for securing a region that stores a program of the CPU 41, a work region, or the like, and includes storage elements such as Random Access Memory (RAM), Electrically Erasable Programmable Read-Only Memory (EEPROM), or the like.

The CPU 41 controls the transport motor 28, which drives the transport roller 25 that transports the paper sheet S, the recording section 26, which discharges ink toward the paper sheet S while moving the carriage 31 in a direction (the X axis direction) that intersects the transport direction (the Y axis direction), the fans 54, which suctions the paper sheet S to the assist roller 53, the nipping motor 56, which drives the nip roller 55 that transports the paper sheet S to the take-up section 16, and various devices that are not illustrated in the drawings, using the control circuit 42.

Transport Method

Figure 7:
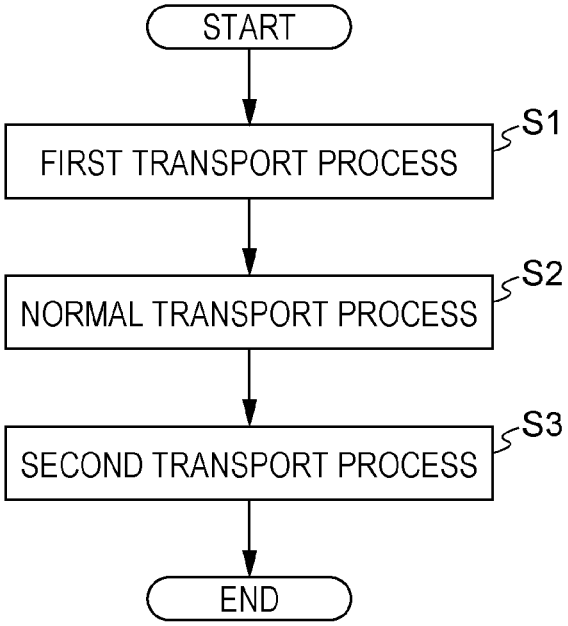
FIG. 7 is a flowchart that describes a transport method of a recording medium.
Figure 8:
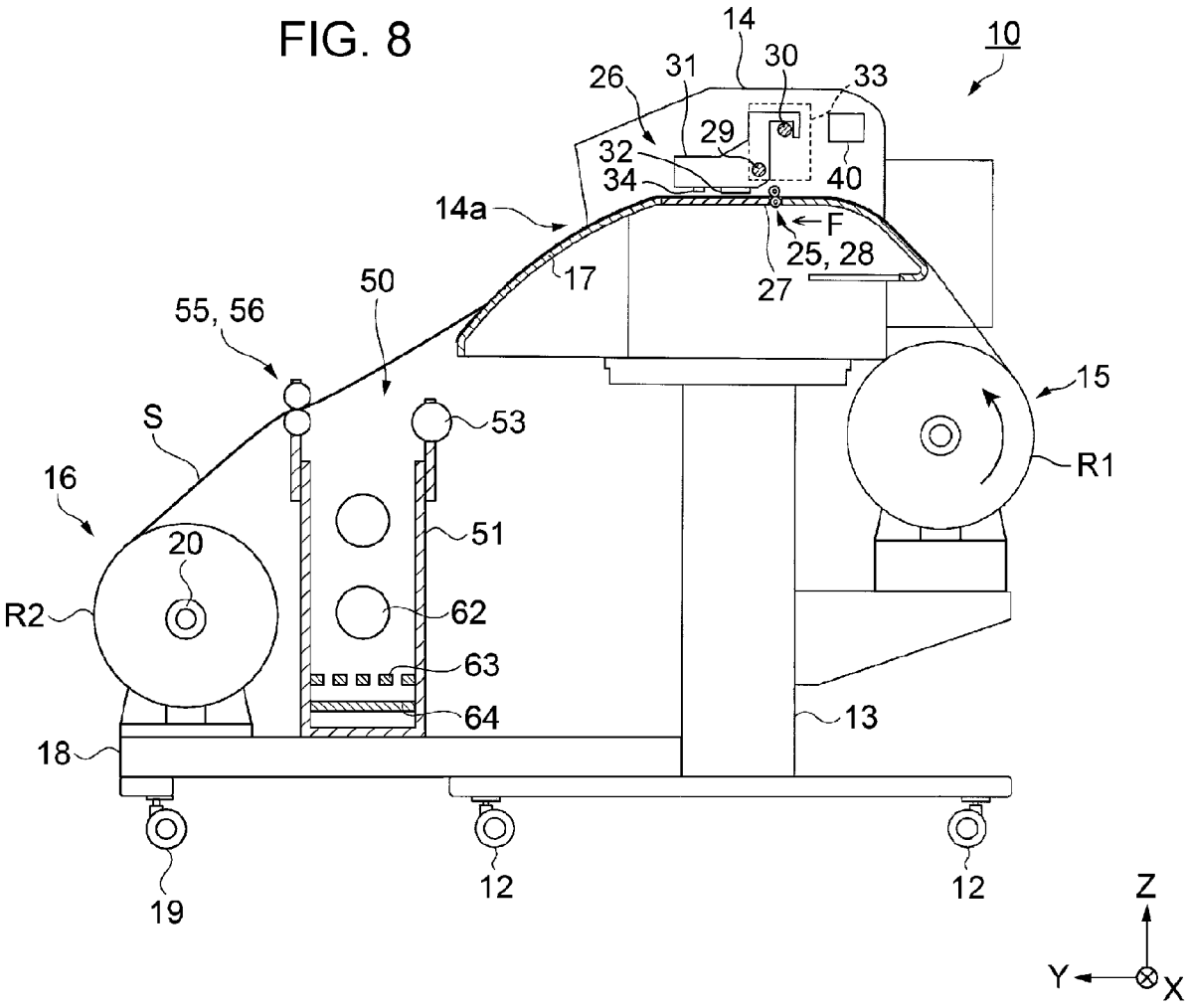
FIG. 8 is a lateral cross-sectional view that describes a transport pathway of the recording medium.
Figure 9:
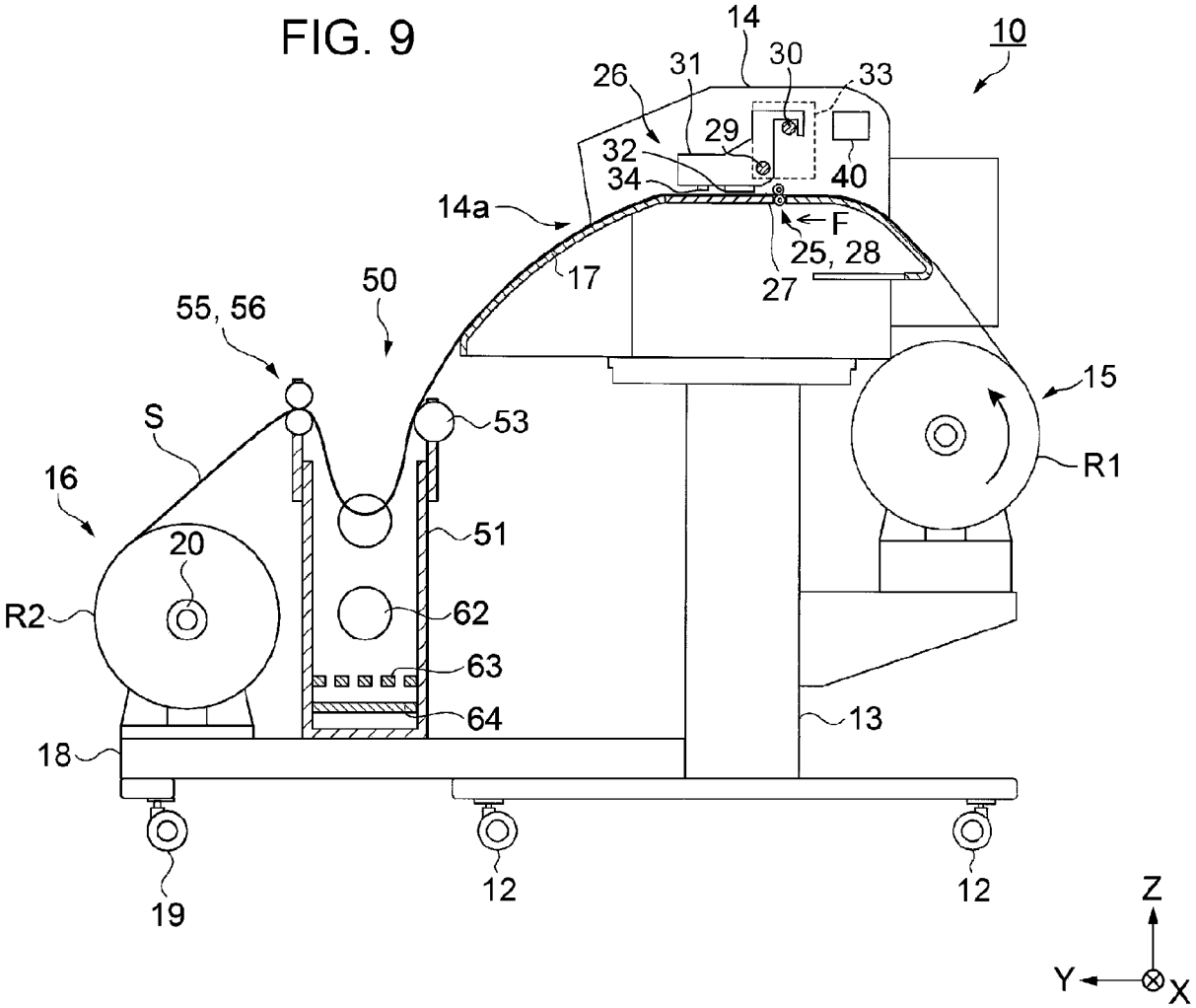
FIG. 9 is a lateral cross-sectional view that describes the transport pathway of the recording medium.

FIG. 7 is a flowchart that describes a transport method of a recording medium. FIGS. 8 and 9 are lateral cross-sectional views that describe the transport pathway of the recording medium. A transport method of the recording medium of the printing apparatus 10 will be described with reference to FIGS. 7 to 9 and FIG. 2.

Firstly, as shown in FIG. 8, as preliminary preparation of the start of printing, the paper sheet S, as a recording medium, is set in the printing apparatus 10 from the feeding section 15 to the take-up section 16 recording section via the recording section 26 and the nip roller 55. In the present embodiment, the paper sheet S is suspended above the drying section 50 between the front of the medium guide section 17 and the nip roller 55. In other words, the paper sheet S is mounted so that the transport pathway forms the shortest route without going inside the drying furnace of the drying section 50 or through the assist roller 53. As a result of this, at the start of printing, it is possible to reduce a region (wasted sheet) in which it is not possible to print on the paper sheet S. Additionally, at the start of printing, the lid 52 of the drying section 50 is detached.

Step S1 is a first transport process. The control section 40 performs a first transport control that transports the paper sheet S, as a recording medium, in the transport direction by driving the transport roller 25, and stops driving of the nip roller 55. To explain in more detail, the control section 40 discharges ink onto the paper sheet S by controlling each device that configures the recording section 26, and transports the paper sheet S toward the drying section 50 by driving the transport roller 25 through control of the transport motor 28. In addition, the control section 40 drives the fans 54 of the assist roller 53, and the fans 61 and the heat sources 62 that the drying furnace of the drying section 50 is provided with.

In the first transport control, since the nip roller 55 is not driven, movement (transport) of the paper sheet S in a take-up section 16 direction is regulated by the nip roller 55. Paper sheet S on which images are formed and which is transported by the transport roller 25, is suctioned to the assist roller 53, and stabilized and supported between the nip roller 55 and the assist roller 53. Furthermore, when the paper sheet S is transported in a drying section 50 direction by the transport roller 25, as shown in FIG. 9, the paper sheet S is inserted inside the drying furnace in a state of sagging down in a U-shape between the assist roller 53 and the nip roller 55 due to the deadweight of the paper sheet S. The control section 40 calculates a transport amount of the paper sheet S on the basis of a rotation amount of the transport motor 28, and as shown in FIG. 2, the first transport control is performed until a leading end of the paper sheet S, which is sagging down inside the drying furnace, reaches a predetermined position (height) that is close to the exhaust plate 63. As a result of this, a long transport pathway is formed inside the drying furnace of the drying section 50. Additionally, the lid 52 is mounted on the drying section 50 in the first transport process.

Step S2 is a normal transport process. The control section 40 performs control that transports the paper sheet S in the transport direction by driving the transport roller 25, and transports the paper sheet S in the transport direction by driving the nip roller 55. The control section 40 controls the transport motor 28 and the nipping motor 56 so that a transport amount of the paper sheet S, which is transported in the drying section 50 direction from the transport roller 25, and a transport amount of the paper sheet S, which is transported in the take-up section 16 direction from the nip roller 55, are the same. As a result of this, in a normal transport process, a long transport pathway that is shown in FIG. 2 is maintained inside the drying furnace.

Step S3 is a second transport process. The control section 40 performs a second transport control that stops driving of the transport roller 25, and transports the paper sheet S, as a recording medium, in the transport direction by driving the nip roller 55. To explain in more detail, the control section 40 calculates a transport amount according to which a tail end of a region on which the printing of images is performed on the paper sheet S, passes through the nip roller 55 in the shortest transport pathway that is shown in FIG. 8, on the basis of a rotation amount of the transport motor 28 after printing on the paper sheet S using the recording section 26 is finished. The control section 40 stops driving of the transport roller 25 by controlling the transport motor 28 if the calculated transport amount is reached. Since the nip roller 55 continues transport of the paper sheet S in the take-up section 16 direction, the transport pathway inside the drying furnace reaches a shortest state, which is shown in FIG. 8, in which the paper sheet S is gradually wound upwards from a longest state, which is shown in FIG. 2, in which the paper sheet S is sagging down inside the drying furnace of the 50 in a U-shape. The control section 40 calculates a transport amount according to which the rear end of a printing region of the paper sheet S passes through the nip roller 55 on the basis of the rotation amount of the nipping motor 56, and finishes all actions by stopping driving of the nip roller 55 by controlling the nipping motor 56 if the calculated transport amount is reached. Additionally, the lid 52 is detached from the drying section 50 midway through the second transport process.

In the abovementioned manner, according to the printing apparatus 10 and the control method of the printing apparatus 10 of the present embodiment, it is possible to obtain the following effects.

The printing apparatus 10 of the present embodiment is provided with a transport roller 25 that is provided on an upstream side of the drying section 50 and transports the paper sheet S, as a recording medium, a nip roller 55 that is provided on a downstream side of the drying section 50 and regulates movement of the paper sheet S, and the assist roller 53 that leads the paper sheet S inside the drying furnace of the drying section 50. Since the drying section 50 is configured in a manner in which it is possible to insert the paper sheet S, in a mounting stage of the paper sheet S before the start of printing, the paper sheet S is mounted so that the transport pathway forms the shortest route without going inside the drying furnace. As a result of this, at the start of printing, since it is possible to reduce a region (wasted sheet) in which it is not possible to print on the paper sheet S, it is possible to improve the production efficiency of the printing apparatus 10.

In addition, when the paper sheet S is transported in the drying section 50 direction by the transport roller 25, and movement of the paper sheet S is regulated by the nip roller 55, the paper sheet S is inserted inside the drying furnace of the drying section 50 in a state of sagging down in a U-shape between the assist roller 53 and the nip roller 55 due to the deadweight of the paper sheet S, and a long transport pathway is formed inside the drying furnace. As a result of this, it is possible to rapidly activate the printing apparatus 10, and therefore, it is possible to further improve production efficiency. In addition, since drying at low temperature and over a long period of time is possible due to the long transport pathway, it is possible to handle heat-sensitive materials as a recording medium.

In addition, when the paper sheet S is transported in the take-up section 16 direction from the drying section 50 by the nip roller 55 in a state in which driving of the transport roller 25 is stopped, the paper sheet S, which is sagging down inside the drying furnace in a U-shape, is wound upward, and the paper sheet S is positioned in the shortest transport pathway. As a result of this, at the end of printing, since it is possible to reduce a region (wasted sheet) in which it is not possible to print on the paper sheet S, it is possible to improve the production efficiency of the printing apparatus 10.

Accordingly, it is possible to provide a printing apparatus 10 in which the production efficiency is high, and the transport pathway inside the drying section 50 is long.

In addition, since the printing apparatus 10 is provided with the heat sources 62 and the fans 61 which feed hot air into the drying section 50, it is possible to dry the paper sheet S, which is inserted into the drying furnace in a U-shape, with high efficiency by keeping the inside of the drying furnace at a predetermined temperature.

In addition, since the printing apparatus 10 is provided with the assist roller 53, it is possible to form a long transport pathway that is stabilized in a U-shape inside the drying furnace of the drying section 50.

The control method of a printing apparatus of the present embodiment includes the first transport control that transports the paper sheet S in the transport direction by driving the transport roller 25, and stops driving of the nip roller 55, and the second transport control that stops driving of the transport roller 25, and transports the paper sheet S in the transport direction by driving the nip roller 55. In a mounting stage of the paper sheet S before the start of printing, the paper sheet S is mounted so that the transport pathway forms the shortest route without going inside the drying furnace. As a result of this, at the start of transport, since it is possible to reduce a region (wasted sheet) in which it is not possible to print on the paper sheet S, it is possible to improve the production efficiency of the printing apparatus 10.

In the first transport process, when the control section 40 performs the first transport control that transports the paper sheet S in the drying section 50 direction by controlling the transport motor 28, and regulates movement of the paper sheet S in the take-up section 16 direction by controlling the nipping motor 56, the paper sheet S is inserted inside the drying furnace of the drying section 50 in a state of sagging down in a U-shape between the assist roller 53 and the nip roller 55 due to the deadweight of the paper sheet S, and a long transport pathway is formed inside the drying furnace. As a result of this, it is possible to rapidly activate the printing apparatus 10, and therefore, it is possible to further improve production efficiency.

In the second transport process, when the control section 40 performs the second transport control that stops transport of the paper sheet S in the drying section 50 direction by controlling the transport motor 28, and continues transport of the paper sheet S in the take-up section 16 direction by controlling the nipping motor 56, the paper sheet S, which is sagging down in a U-shape inside the drying furnace, is wound upward and positioned in the shortest transport pathway. As a result of this, at the end of printing, since it is possible to reduce a region (wasted sheet) in which it is not possible to print on the paper sheet S, it is possible to improve the production efficiency of the printing apparatus 10.

Accordingly, it is possible to provide a control method of a printing apparatus according to which it is possible to configure a printing apparatus 10 in which the production efficiency is high, and the transport pathway inside the drying section 50 is long.

Embodiment 2

Figure 10:
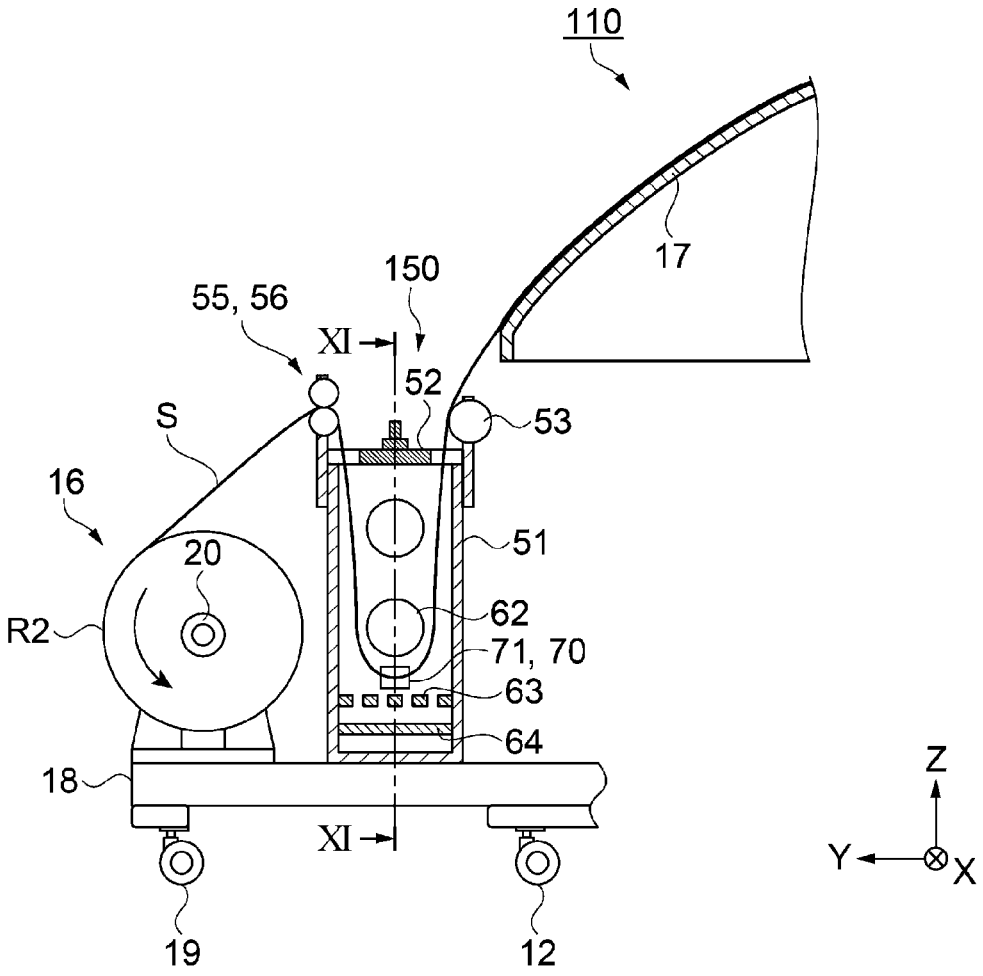
FIG. 10 is a lateral cross-sectional view in which a printing apparatus according to Embodiment 2 is partially enlarged.
Figure 11:
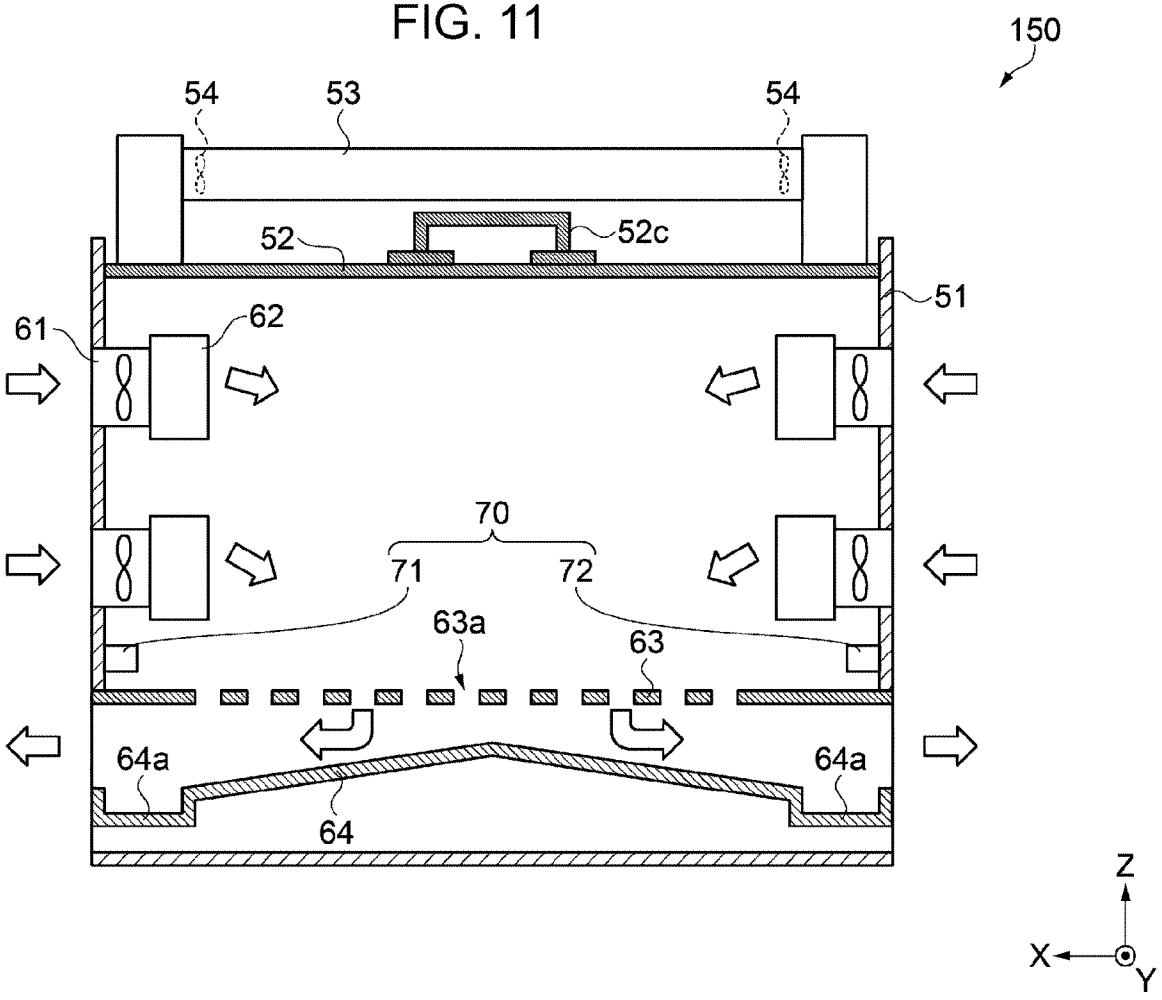
FIG. 11 is a cross-sectional view along a line XI-XI in FIG. 10.

FIG. 10 is a lateral cross-sectional view in which a printing apparatus according to Embodiment 2 is partially enlarged. FIG. 11 is a cross-sectional view of a drying section along a line XI-XI in FIG. 10. Additionally, in FIG. 11, illustration of the paper sheet S is omitted. Next, a printing apparatus 110 according to the present embodiment will be described. Additionally, constituent sites that are the same as those of Embodiment 1 will be given the same reference numerals, and overlapping descriptions thereof will be omitted. The printing apparatus 110 of the present embodiment is provided with a medium detection sensor 70 that detects the paper sheet S, as a recording medium, in the drying furnace of a drying section 150.

As shown in FIGS. 10 and 11, the printing apparatus 110 is provided with the drying section 150. The medium detection sensor 70, which detects a lower end of a paper sheet S that is inserted in a U-shape, is included in a drying furnace of the drying section 150. The medium detection sensor 70 is configured to include a light emission section 71, which includes a light emitting element, or the like, that radiates light, and a light reception section 72, which includes a light receiving element, or the like, that receives light. The light emission section 71 is provided on one side wall of the drying section housing 51 in the width direction (±X axis direction), and the light reception section 72 is provided on the other side wall. In addition, the light emission section 71 and the light reception section 72 are provided at a height of a lower end of a U-shape when the paper sheet S is inserted up to a predetermined position, and an optical axis of the light emission section 71 faces the light reception section 72.

Light that is radiated from the light emission section 71 is received by the light reception section 72. However, when the lower end of a U-shape of the paper sheet S passes between the light emission section 71 and the light reception section 72, light that is radiated from the light emission section 71 is blocked by the paper sheet S and is not received by the light reception section 72. In a case in which the control section 40 sets a signal that is output when the light reception section 72 receives the light of the light emission section 71 to "ON", and sets a signal that is output when the light reception section 72 is not able to receive the light of the light emission section 71 to "OFF", it is possible to determine whether the lower end of the paper sheet S is positioned on an upper side (a +Z axis side) or positioned on a lower side (a −Z axis side) of a predetermined position by counting number of times that the "OFF" signal is output.

In the first transport process that was mentioned in Embodiment 1, the control section 40 transitions to the normal transport step when an initial "OFF" signal is received. In addition, in the normal transport process, it is possible to keep the lower end of the paper sheet S, which is inserted inside the drying furnace of the drying section 50 at a predetermined height as a result of the control section 40 adjusting a rotation speed of the nip roller 55 by controlling the nipping motor 56 on the basis of the signal that is output from the light reception section 72. As a result of this, even in a case in which a transport error occurs in the paper sheet S due to continuous operation over a long period of time, it is possible for the printing apparatus 110 continue printing retaining a predetermined long transport pathway inside drying section 50 without change.

In the abovementioned manner, according to the printing apparatus 110 of the present embodiment, it is possible to obtain the following effects.

Since the printing apparatus 110 is provided with the medium detection sensor 70 that detects the lower end of the paper sheet S, which is inserted into the drying furnace in a U-shape, even in a case in which a transport error occurs in when transporting the paper sheet S, it is possible to keep the paper sheet S in a predetermined transport pathway.

This application claims priority under 35 U.S.C. §119 to Japanese Patent Application No. 2015-168733, filed Aug. 28, 2015. The entire disclosure of Japanese Patent Application No. 2015-168733 is hereby incorporated herein by reference.

What is claimed is:

1. A printing apparatus comprising:

a printing head that discharges a liquid onto a recording medium;

a drying section into which it is possible to insert the recording medium;

a transport roller that transports the recording medium in a transport direction, and is provided further on an upstream side than the drying section in the transport direction;

a nip roller that is provided further on a downstream side than the drying section in the transport direction;

a medium support section for supporting the recording medium;

a take-up section for receiving the recording medium, wherein the drying section is located between the medium support section and the take-up section in the transport direction; and a control section that regulates movement of the recording medium by controlling the nip roller, wherein the control section performs:

a first transport control that transports the recording medium in the transport direction by driving the transport roller, and stops driving of the nip roller, to thereby cause the recording medium to sag downward in a direction of gravity inside a housing of the drying section, and a second transport control that stops driving of the transport roller, and transports the recording medium in the transport direction by driving the nip roller to thereby cause a transport path of the recording medium in the housing of the drying section to be less than a transport path during the first transport control.

2. The printing apparatus according to claim 1, further comprising an assist roller that leads the recording medium inside the drying section.

3. The printing apparatus according to claim 1, wherein the drying section is provided with a heat source that emits heat, and an air blowing fan that blows external air inside the drying section.

4. The printing apparatus according to claim 1, wherein the drying section includes a medium detection sensor that detects the recording medium.

5. The printing apparatus according to claim 1, wherein the drying section includes a condensation induction plate that is provided in a position that faces an exhaust port, and causes matter, which is included in vapor that is ventilated from the exhaust port, to form as condensation.

6. A control method of a printing apparatus that includes a printing head that discharges a liquid onto a recording medium, a drying section into which it is possible to insert the recording medium, a transport roller that transports the recording medium in a transport direction and is provided further on an upstream side than the drying section in the transport direction, a nip roller that is provided further on a downstream side than the drying section in the transport direction, a medium support section for supporting the medium, a take-up section for receiving the recording medium, wherein the drying section is located between the medium support section and the take-up section in the transport direction, and a control section that regulates movement of the recording medium by controlling the nip roller, the control method comprising:

performing a first transport control that transports the recording medium in the transport direction by driving the transport roller, and stops driving of the nip roller to thereby cause the recording medium to sag downward in a direction of gravity inside a housing of the drying section; and performing a second transport control that stops driving of the transport roller, and transports the recording medium in the transport direction by driving the nip roller to thereby cause a transport path of the recording medium in the housing of the drying section to be less than a transport path during the first transport control.

* * * * *